United States Patent [19]

Botula

[11] 3,955,680

[45] May 11, 1976

[54] APPARATUS AND METHOD FOR SEGREGATING DIFFERENT SIZE ARTICLES

[75] Inventor: Bernard C. Botula, Gaithersburg, Md.

[73] Assignee: Fairchild Industries Inc., Germantown, Md.

[22] Filed: Sept. 21, 1973

[21] Appl. No.: 399,483

[52] U.S. Cl. ..... 209/116

[51] Int. Cl.² ..... B07C 1/00

[58] Field of Search ..... 209/112, 116, 100, 123, 209/118, 119, 120; 193/43 B; 198/33.1, 65, 68

[56] References Cited

UNITED STATES PATENTS

| | | | |
|---|---|---|---|
| 389,242 | 9/1888 | Palmer | 198/187 |
| 2,724,498 | 11/1955 | Beresford | 209/112 |
| 3,120,888 | 2/1964 | Piel | 198/33 AA |
| 3,412,855 | 11/1968 | Nilmeier et al. | 209/100 X |

FOREIGN PATENTS OR APPLICATIONS

| | | | |
|---|---|---|---|
| 633,688 | 2/1928 | France | 209/112 |

*Primary Examiner*—Allen N. Knowles
*Attorney, Agent, or Firm*—Michael W. York

[57] ABSTRACT

An apparatus and method for segregating different size articles in which the articles to be segregated are transported along a moving canted conveyor and permitted to slide onto the upper end of an inclined chute which has a divider located substantially parallel to the long axis of the chute. The shape and location of the divider causes the smaller size articles to be directed to one side of the divider and larger size articles to be directed to the other side of the divider. The segregated different size articles then pass to different portions of a second chute which is at a lesser incline than the first chute and this serves to reduce the speed of the articles. The segregated articles are contained in separate portions of the second chute by compact gates which can be individually activated to permit the segregated articles to slide off the lower end of the second chute.

6 Claims, 6 Drawing Figures

APPARATUS AND METHOD FOR SEGREGATING DIFFERENT SIZE ARTICLES

BACKGROUND OF THE INVENTION

It is frequently desirable to segregate different size articles such as parcels and the like without having to resort to manual methods or to complex detection or measuring equipment, since manual methods are quite slow and complex detection measuring equipment is expensive. This is particularly true with respect to a large number of packages or parcels which are handled by the United States Postal Service since segregation of different size packages or parcels permits easier sorting and distribution of the packages or parcels. Segregation of different size parcels in postal operations is desirable since this permits the culling out of different size parcels which are not processable by a particular machine such as a particular type of sorting machine. In addition, different size parcels can be separated so that parcels of different sizes can be processed by separate machines, such as by a small parcel sorter and a large parcel sorter. Furthermore, the separation of packages by size provides segregated packages which permit personnel to more conveniently place the packages in containers. For example, if segregated packages or parcels are readily available the personnel can place the large or bulky packages in the bottom of the container and use the smaller packages by placing them in crevaces or by placing them on top of the larger packages. In spite of the desirability of being able to segregate different size parcels or packages, prior to the present invention it has not been possible to rapidly, economically and simply segregate such packages or parcels in large numbers without the need for complex equipment.

The present invention overcomes the disadvantages associated with the prior systems and permits large numbers of parcels to be rapidly and economically segregated without the need for complex equipment through the use of inexpensive passive equipment.

BRIEF DESCRIPTION OF THE INVENTION

This invention relates to apparatus and methods for segregating different size articles and more particularly to apparatus and methods for segregating different size articles which utilize a passive device.

It is an object of the present invention to provide an apparatus and method for rapidly segregating different size articles.

It is an object of the present invention to provide a simple and efficient apparatus and method for segregating different size articles.

It is an object of the present invention to provide an apparatus and method for segregating different size articles which reduces the possibility of damage to the articles.

It is an object of the present invention to provide an apparatus and method for segregating different size articles in which the possibility of the jamming of articles is limited or greatly reduced.

It is also an object of the present invention to provide an apparatus and method for segregating different size articles which permits the segregated articles to be readily available for use.

It is an object of the present invention to provide an apparatus and method for segregating different size articles which permits culling out of oversize packages and the like which might not be processable by a particular machine.

It is also an object of the present invention to provide an apparatus and method for segregating different size articles in which different size packages or parcels or the like can be separated to permit different size packages or parcels to be more efficiently processed by separate machines.

It is also an object of the present invention to provide an apparatus and method for segregating different size articles in which packages or the like can be separated by size to permit personnel to conveniently place the packages in containers.

It is also an object of the present invention to provide an apparatus and method for segregating different size articles which are particularly useful in postal type operations.

It is also an object of the present invention to provide an apparatus and method for segregating different size articles that can be utilized in connection with articles which are rapidly moving on a conveyor.

The present invention provides an apparatus for segregating different size articles which includes a chute and a divider located on the chute which has its long axis substantially parallel to the long axis of the chute and whose height increases from the upper end portion to the lower portion of the chute. Means are also provided for moving the articles to be segregated onto the upper end of the chute.

The present invention also provides a method for segregating different size articles including the steps of providing an inclined chute having a divider located thereon, causing the articles to be segregated to move onto the upper end portion of the chute and causing the articles to separate into two paths as a function of article size through the use of the chute and the divider.

BRIEF DESCRIPTION OF THE DRAWINGS

The invention will be hereinafter more fully described with reference to the accompanying drawings which.

DETAILED DESCRIPTION OF THE PREFERRED EMBODIMENT

Figure 1:
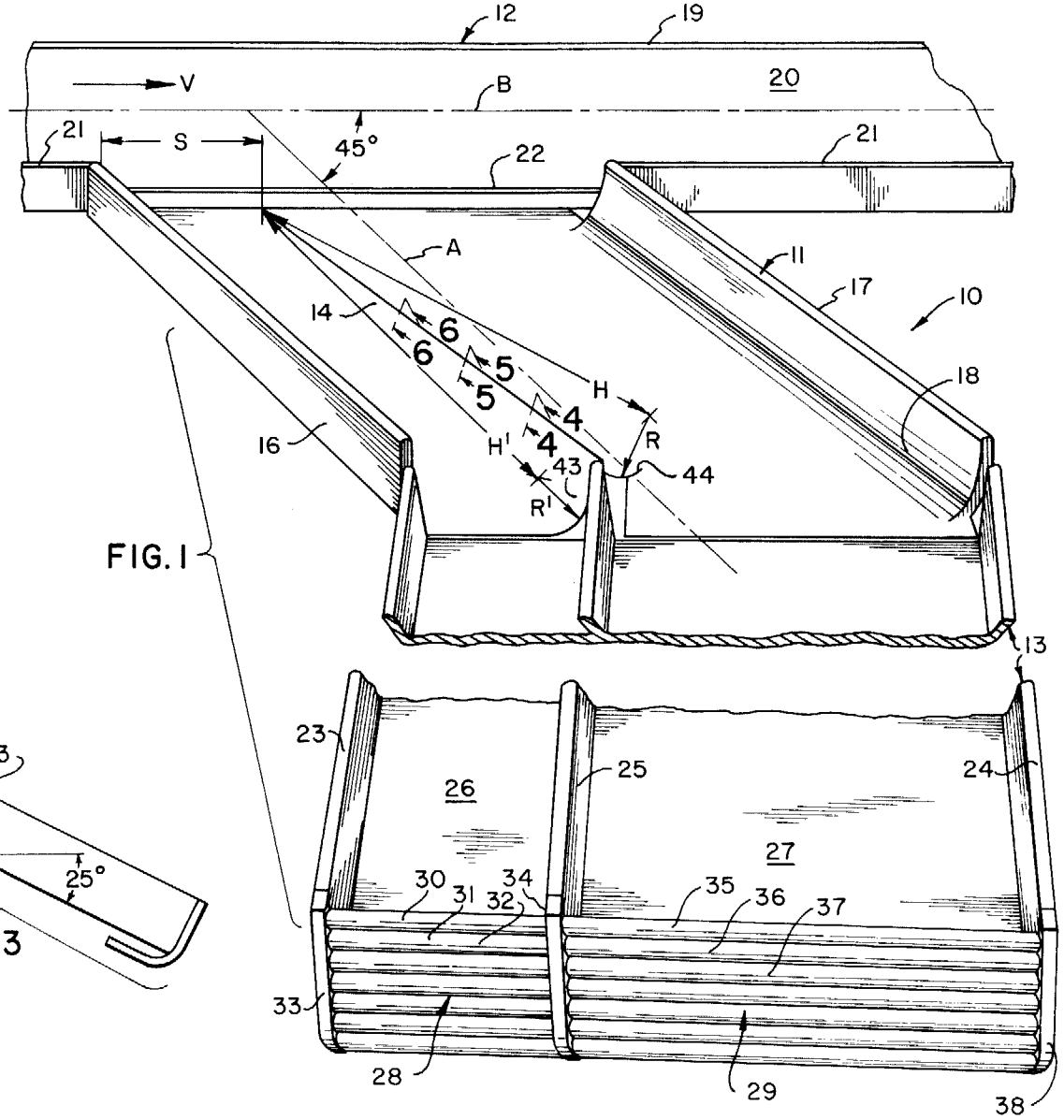
FIG. 1 is a perspective view of the apparatus for segregating different size articles of the present invention.
Figure 2:
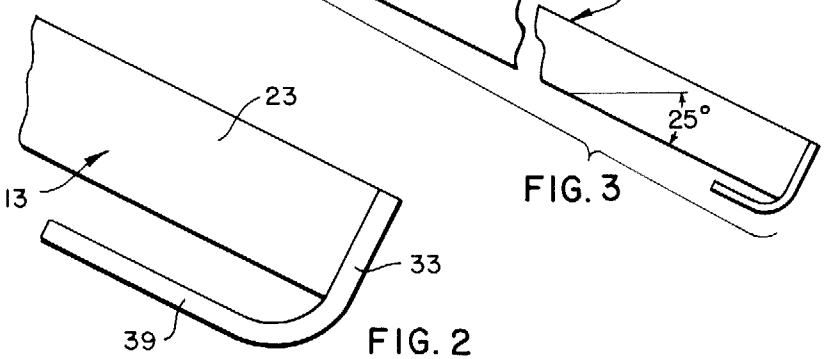
FIG. 2 is a side elevational view of a portion of the structure illustrated in FIG. 1.
Figure 3:
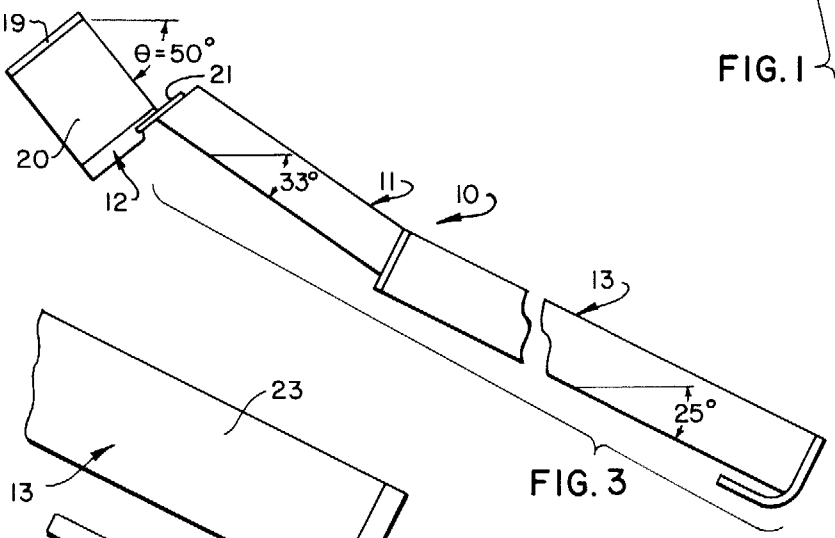
FIG. 3 is a reduced side elevational view of the structure illustrated in FIG. 1.

Referring first to FIGS. 1 through 3, the apparatus for segregating different size articles is illustrated and is designated generally by the number 10. The apparatus for segregating different size articles 10 comprises an inclined chute 11, a conveyor 12 located adjacent to the upper end of the chute 11 and a lower inclined chute 13 which is connected to the lower end portion of the chute 11. The chute 11 has a divider 14 located on its upper surface and the long axis of the divider or protuberance is substantially parallel to the long axis A of the chute 11 and the inner surface of the chute 11 is substantially flat except for the protuberance. The chute 11 also has two upward extending sides 16 and 17 and as illustrated for the side 17 each side has a lower curved portion 18 which prevents articles such as packages and the like from jamming up against the side. The conveyor 12 is canted or tilted and it comprises a conveyor framework 19, a conveyor belt 20 upon which the articles are to be segregated ride and a fence 21 which holds the articles on the conveyor belt. The long axis A of the chute 11 forms substantially a 45° angle with the long axis B of the adjacent portion of the conveyor belt 20. An opening 22 is provided in the fence 21 to permit articles on the conveyor belt 20 to slide onto the upper end portion of the chute 11. The lower chute 13 has two sides 23 and 24 and a divider 25 which serve to segregate the chute into two separate portions 26 and 27 for segregated articles such as parcels and the like which slide to it from the chute 11.

As best illustrated in FIGS. 1 and 2 the lower end of each chute portion 26 and 27 has a respective gate 28 and 29 which serve to retain articles in the lower end portion of the chute 13. The gate 28 comprises a series of parallel mounted interconnected tubular members such as the tubular members designated 30, 31 and 32 whose respective ends ride in the grooves in the respective guides 33 and 34. In a similar manner the gate 29 comprises a series of interconnected tubular members 35, 36 and 37 whose respective ends ride in the grooves in the respective guides 34 and 38. As illustrated in FIG. 2, the bracket 33 has a lower straight portion 39 and the other guides 34 and 38 also have a similar straight portion. Consequently, the guides 33 and 34 permit the combined tubular structure including the members 30, 31 and 32 to be pushed downward so that the tubular members enter a straight portion 39 of the guide 33 and the associated portion of the guide 34 and this will permit any articles located in the lower end of the portion 26 of the chute 13 to slide out of the chute. In a similar manner, the combined tubular structure including the tubular members 35, 36 and 37 can be pushed downward so that any articles located in the lower end portion 27 of the chute 13 will also slide out of the chute.

As illustrated in FIG. 3, the upper surface of the conveyor 12 is tipped or canted at substantially an angle of 50° with respect to the horizontal so that the packages may readily slide off of the conveyor and onto the upper end of the chute 11 when the fence 21 no longer holds the packages on the conveyor belt 20. The bottom of the chute 11 also has an incline of substantially 33° with respect to the horizontal and this tends to slow the packages or parcels as they slide off the conveyor 12. The bottom of the lower chute 13 has even a lesser slope than the bottom of the upper chute 11 and it only has an angle of substantially 25° with respect to the horizontal which tends to further retard the velocity of the parcels located on the chute.

Figure 4:
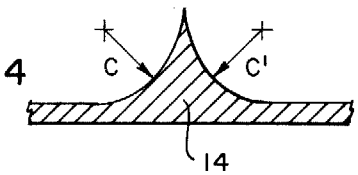
FIG. 4 is a sectional view taken on the plane indicated by the line 4—4 of FIG. 1.
Figure 5:
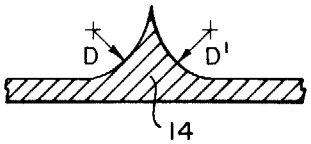
FIG. 5 is a sectional view taken on the plane indicated by the line 5—5 of FIG. 1.
Figure 6:
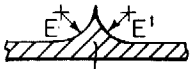
FIG. 6 is a sectional view taken on the plane indicated by the line 6—6 of FIG. 1.

Important details of the construction of the divider 14 are illustrated in FIGS. 4 through 6 and in FIG. 1. As illustrated, the divider 14 comprises a protuberance whose height increases from the upper end portion of the chute 11 to the lower end portion of the chute and both sides 43 and 44 of the divider are shaped to form a segment of the surface of a right cone with a radius equal to R or R′ and an altitude H or H′. Consequently, the radii C and C′ illustrated in FIG. 4 are equal and larger than the equal radii D and D′, illustrated in FIG. 5. In a similar manner, the radii D and D′ in FIG. 5 are equal but greater than the radii E and E′ illustrated in FIG. 6. It has been unexpectedly determined based upon results using postal type parcels, that the ratio H/R or the equal ratio H′/R′ should be between about 5 and about 8 and preferably about 6.4 for good results.

The shapes of the surfaces 43 and 44 of the divider 14 are important since these surfaces prevent parcels or packages from experiencing high frictional retardation as a result of wedging between the bottom of the chute 11 and the divider 14 which is perpendicular to the bottom. In addition, the shape of the surface 43 is particularly important because the shape of the surface permits the divider to cause proper segregation of the articles such as parcels and the like which are to be segregated. The shape of the surface 43 permits larger size articles to pass over the upper end portion of the divider 14 and hence be confined between the divider and the wall 17 of the chute. The shape of the surface 43 also causes the smaller packages to be confined between the divider 14 and the wall 16 of the chute 11. The concave surface 43 also prevents the parcels or packages from being damaged when they strike the divider 14.

The location of the divider 14 is also very important for the proper operation of the apparatus for segregating different size articles 10. As illustrated in FIG. 1, the apex of the divider 14 is located at a distance $s$, in inches, from the forward edge of the opening 22 in the fence 21. The other important parameters associated with the location of the divider and the segregation of different size articles such as packages and the like are listed below:

$w$ = Width of the package (inches)

$g$ = Acceleration due to gravity (in/sec$^2$)

$\theta$ = Tilt or cant angle of the conveyor belt with respect to the horizontal (degrees)

$l$ = Length of the package (inches)

$v$ = Velocity of the conveyor belt (inches per second)

$c$ = Empiracal constant = 1.25

$\mu$ = Coefficient of friction, package with conveyor belt

It has been determined that if $$c\sqrt{\frac{w}{g(\sin\theta - \mu\cos\theta)}} < \frac{s - \frac{l}{2}}{v}$$

for a package or parcel with a given length $l$ and a given width w, the package or parcel will follow a path as it leaves the moving conveyor belt 20 which will place it on the near side of the divider 14. On the other hand if $$c\sqrt{\frac{w}{g(\sin\theta - \mu\cos\theta)}} > \frac{s - \frac{l}{2}}{v}$$

for a package or parcel with a given length $l$ and a given width $w$, the package or parcel will follow a path as it leaves the moving conveyor belt 20 which will place it on the far side of the divider 14. In general, the larger size packages or parcels will follow paths which place them on the far side of the divider 14.

In view of the foregoing, once the length $l$ and the width $w$ of a hypothetical package which is to serve as the size package about which the division or segregation is to occur have been selected, the location of the desired location of the divider 14 can easily be determined. Using the desired values for $l$ and $w$, the location of the divider 14 can be determined by solving the following equation for s to determine the distance, in inches, from the forward edge of the opening 22 in the fence 21 to the apex of the divider 14.

$$s = vc\sqrt{\frac{w}{g(\sin\theta - \mu\cos\theta)}} + \frac{l}{2}$$

Where: $w$, $g$, $\theta$, $l$, $v$, $c$, $\mu$ all refer to the previously identified parameters or have the previously indicated value.

It is also to be noted that if the values of $l$ and $w$ for the articles to be segregated are desired to be altered from those chosen in a given apparatus design it is a simple matter to change the belt 20 velocity to the appropriate value as determined by solving the above equation for $v$ as follows:

$$v = \frac{(s - \frac{l}{2})}{c\sqrt{\frac{w}{g(\sin\theta - \mu\cos\theta)}}}$$

The apparatus for segregating different size articles 10 is utilized and the method of this invention is carried out in the following manner. Both of the gates 28 and 29 are placed originally in their closed positions and the conveyor 12 is started to cause the belt 20 to operate at the desired speed. The articles such as packages, parcels and the like which are to be segregated are fed onto a portion of the conveyor belt 20 which is located to the left of the portion of the conveyor belt which is illustrated in FIG. 1. The fence 21 will hold the parcels and packages on the conveyor belt 20 and the friction between the conveyor belt and parcels and packages on the conveyor belt will cause the conveyor belt to transport the packages or parcels in the direction indicated by the arrow in FIG. 1. The packages or parcels will continue to remain on the conveyor belt 20 until they reach the opening 22 in the fence 21.

When the parcels reach the opening 22 they slide off of the conveyor belt 20 and onto the upper end portion of the chute 11. It should be noted that the parcels will be moving diagonally with respect to the long axis of the divider 14 since they have a forward velocity caused by the movement of the conveyor belt 20 and the downward velocity caused by gravity which causes them to slide off the conveyor belt. The smaller parcels tend to take one path and move onto the upper end portion of the chute 11 as soon as they pass the forward edge of the opening 22. On the other hand, the larger parcels take another path and do not tend to move off of the conveyor belt 20 and fully onto the upper end portion of the chute 11 until their center of gravity is beyond the location of the divider 14. A number of the parcels to be segregated may actually strike the divider 14. However, the shape of the surface 43 of the divider causes the smaller size parcels to slide back and tend to remain to the left of the divider between the divider 14 and the wall of the chute 16. At the same time the shape of the surface 44 of the divider 14 permits larger size parcels which ride over the top of the divider to then fall between the divider 14 and the opposite wall 17 of the chute 11. The shape of the divider 14 is such that no damage or deleterious effects occur to parcels when striking the divider 14.

During the transfer of the parcels from the moving conveyor 20 onto the upper end of the chute 11 some of the parcels may strike or move against the wall 16 or the wall 17, however the shape of the interior walls is concave as illustrated by the number 18 and this prevents these parcels from jamming up against the wall and permits them to readily slide down the appropriate side of the chute 11. The fact that the central long axis of the chute 11 is substantially at a 45° angle with the long axis from the conveyor belt 20 assists in reducing the velocity of the parcels since the parcels tend to move and ride against the interior surface of the wall 16 and the interior surface 44 of the divider 14.

After the smaller size parcels have been segregated between the divider 14 and the wall 16 of the chute 11 and the larger size parcels have been segregated between the divider 14 and the wall 17 of the chute, the segregated parcels slide down their respective sides of the chute 11 and onto the respective upper ends of the portions 26 and 27 of the lower chute 13 where the segregated parcels will remain segregated by virtue of the centrally located wall 25. As previously indicated, the lower chute 13 is at a lesser incline than the upper chute 11 and consequently the lesser slope associated with the chute 13 tends to reduce the velocity of the parcels. It is important that the parcels be slowed down so that they do not obtain a velocity which would result in possible damage to the parcels. The larger parcels in the upper end of the portion 27 of the chute slide down that portion of the chute until they come in contact with the gate 29 or in contact with other parcels that are in contact with the gate. In a similar manner, the smaller parcels which are located in the upper end of the portion 26 slide down that portion of the chute until they come in contact with the gate 28 or until they come in contact with other parcels which have come in contact with that.

When a sufficient number of parcels have accumulated in the lower end of the chute portion 26, the gate 28 is activated to cause all or some of the parcels to become discharged by gravity from the chute. In a similar manner, once a sufficient number of parcels have accumulated in the lower end portion of the chute 27, the gate 29 is activated to cause discharge of all or some of the parcels by gravity from the portion 27. Activation of the gate 28 can be accomplished by causing the tubular members such as the tubular members designated by the numbers 30, 31 and 32 to move downward so that all or most of the tubular members are located below the lower surface of the chute 13. Activation of the gate 29 can be accomplished in a similar manner in that the tubular members such as the tubular members designated by the numbers 35, 36 and 37 are caused to move downward so that most or all of the tubular members are located below the lower portion of the chute 13.

The manner in which the gates 28 and 29 operate is very important since it permits a cart or other similar vehicle to be brought to the immediate vicinity of the lower end of the portion of the chute 26 or 27 and the gate operated without having any portion of the gates strike or interfere with the cart or other similar vehicle. This would not be the case if a conventional rigid gate was pivotally connected at its lower end to the lower end of the chute portion 26 and 27 since upon opening the rigid gate it could strike or otherwise interfere with the vehicle. Furthermore, the configuration of the gates 28 and 29 permits a series of similar type chutes such as the chute 13 to be stacked one above each other with very little distance between the chutes since the various gates can be operated without having the gates interfere with the chutes which are located below the gates which are operated in view of the fact that there are no downward extending gates which would interfere with the lower chutes.

It will, of course, be appreciated that the sizes into which the parcels are going to be segregated can be varied by altering the location of the divider 14 by changing the speed of the belt 20 and hence the velocity of the parcels as they move onto the upper end portion of the chute and by changing the cant or tip of the conveyor and these parameters can be adjusted using the previously set forth equations or formulas to obtain the desired segregation of the parcels or other articles which are to be segregated. In addition, of course, the size of the opening 22 in the fence 21 or the width of the chute 11 will have some effect on the segregation of the articles.

Although the invention has been described in considerable detail with reference to certain preferred embodiments it will be understood that the variations or modifications may be made within the spirit and scope of the invention as defined in the appended claims.

What is claimed is:

1. An apparatus for segregating different size articles with an inclined chute and means located adjacent to the upper end of the chute for causing the articles to be segregated to be moved onto the upper end portion of the chute, wherein the improvement comprises segregating means located on said chute for impacting with at least some of the articles which are to be segregated and for segregating the articles as a function of article size and velocity, said segregating means including an elongated protuberance having at least one inclined side surface for coming into contact with at least some of the articles being segregated, a second inclined chute having its upper end portion located adjacent to the lower end portion of said first chute, said second chute being inclined at a lesser angle than said first chute, means located in said second chute for keeping the articles which have been separated confined to separate portions of said second chute, and separate gate means located at the lower end portion of said second chute for retaining the separated articles in separate portions of the lower end of said second chute.

2. An apparatus for segregating different size articles with an inclined chute having an upper end portion with two edges, wherein the improvement comprises segregating means located on said chute for impacting with at least some of the articles which are to be segregated and for segregating the articles as a function of article size and velocity, said segregating means including an elongated protuberance having at least one inclined side surface for coming into contact with at least some of the articles being segregated, said protuberance being located between the edge of the chute which is located closest to the articles which are to be segregated and the centerline of the chute, and movable conveying means located adjacent to the upper end portion of said inclined chute, said movable conveying means being tilted toward the upper end portion of said inclined chute for permitting the different size articles to move off of said movable conveying means and onto the upper end portion of said inclined chute.

3. The appartus of claim 2 wherein one side of said protuberance is shaped to correspond to substantially a portion of the surface of a cone.

4. The apparatus of claim 3 wherein the opposite side of said protuberance is also shaped to correspond to substantially a portion of the surface of a cone.

5. The apparatus of claim 3 where in the ratio of the altitude of said cone to the radius of the base of said cone is between about 5 and about 8.

6. A method for segregating different size articles comprising the steps of providing a canted moving conveyor and an inclined chute having a divider located thereon and an upper end portion located adjacent to said canted moving conveyor, causing the articles to be segregated to move on said canted moving conveyor, causing the articles to be segregated which are located on said moving conveyor to move off of said moving conveyor and onto the upper end portion of said chute and then causing the articles to separate into two paths as a function of article size and velocity through the use of said chute and said divider and adjusting the size of the article about which segregation takes place by changing the velocity of said articles as they move onto the upper end portion of said chute from said canted conveyor.

* * * * *